US006893486B2

(12) United States Patent
Sanderford et al.

(10) Patent No.: US 6,893,486 B2
(45) Date of Patent: May 17, 2005

(54) METHOD AND SYSTEM FOR SEA-BASED HANDLING OF HYDROCARBONS

(75) Inventors: Morten Sanderford, Randaberg (NO); Bernt Helge Torkildsen, Bergen (NO); Jens Grendstad, Mjøndalen (NO); Egil Tveit, Woking (GB); Olav Inderberg, Kongsberg (NO)

(73) Assignees: Navion ASA, Stavanger (NO); Framo Engineering AS, Sandsli (NO); Kongsberg Offshore AS, Kongsberg (NO)

( * ) Notice: Subject to any disclaimer, the term of this patent is extended or adjusted under 35 U.S.C. 154(b) by 112 days.

(21) Appl. No.: 10/275,309

(22) PCT Filed: Apr. 27, 2001

(86) PCT No.: PCT/NO01/00178

§ 371 (c)(1),
(2), (4) Date: Apr. 22, 2003

(87) PCT Pub. No.: WO01/83947

PCT Pub. Date: Nov. 8, 2001

(65) Prior Publication Data

US 2003/0159581 A1 Aug. 28, 2003

(30) Foreign Application Priority Data

May 4, 2000 (NO) ..... 20002356

(51) Int. Cl.[7] ..... B01D 19/00

(52) U.S. Cl. ..... 95/243; 95/258; 95/259; 96/155; 96/187; 166/267; 166/354; 166/357

(58) Field of Search ..... 95/243, 254, 258, 95/259; 96/155, 187; 166/267, 357, 352, 354

(56) References Cited

U.S. PATENT DOCUMENTS

| | | | | |
|---|---|---|---|---|
| 3,221,816 A | * | 12/1965 | Shatto, Jr. et al. | 166/357 |
| 3,556,218 A | * | 1/1971 | Talley, Jr. et al. | 166/265 |
| 3,608,630 A | * | 9/1971 | Wooden et al. | 166/357 |
| 4,159,036 A | | 6/1979 | Wilson et al. | 166/267 |
| 4,527,632 A | | 7/1985 | Chaudot | 166/357 |

(Continued)

FOREIGN PATENT DOCUMENTS

| | | |
|---|---|---|
| GB | 2 195 606 | 4/1988 |
| GB | 2 341 875 | 3/2000 |
| NO | B 152 730 | 11/1985 |
| NO | B 166 145 | 6/1991 |
| NO | C 173 838 | 2/1994 |
| NO | 943743 | 10/1994 |
| NO | 180 350 | 4/1997 |

*Primary Examiner*—Richard L. Chiesa
(74) *Attorney, Agent, or Firm*—Andrus, Sceales, Starke & Sawall, LLP

(57) ABSTRACT

A method and system for sea-based handling/treatment of fluid hydrocarbons (oil) with associated gas include a first separation step in a high-pressure separator (18) installed on the sea bed, from which is output an oil flow containing an essentially predefined percentage of residual gas. The oil containing residual gas is carried through a riser (22) up to a surface vessel/production ship (12), where it is subjected to a second separation step in a second separator (24) incorporated in a low-pressure surface plant on board the vessel (12), this separated residual gas being used as fuel for direct/indirect generation of electric power for the operation of the underwater and above-water sections of the system. Water and gas produced in the first separation step is returned to a suitable reservoir by the use of a multiphase pump.

18 Claims, 1 Drawing Sheet

U.S. PATENT DOCUMENTS 4,960,443 A * 10/1990 Lansford ..... 95/253
5,878,814 A * 3/1999 Breivik et al. ..... 166/267
5,950,732 A 9/1999 Agee et al. ..... 166/354
6,012,530 A 1/2000 Korsgaard ..... 166/352
6,155,047 A * 12/2000 Streetman ..... 60/398
6,267,182 B1 * 7/2001 Lima ..... 166/335
6,276,455 B1 * 8/2001 Gonzalez ..... 166/357
6,296,060 B1 * 10/2001 McCaslin ..... 166/357

* cited by examiner

METHOD AND SYSTEM FOR SEA-BASED HANDLING OF HYDROCARBONS

CROSS REFERENCE TO RELATED APPLICATION

The present application is the U.S. national stage application of International Application PCT/NO01/00178, filed Apr. 27, 2001, which international application was published on Nov. 8, 2001 as International Publication WO 01/83947. The International Application claims priority of Norwegian Patent Application 20002356, filed May 4, 2000.

SUMMARY OF THE INVENTION

The present invention relates to a method and system including processing plant, for sea-based treatment/handling of fluid hydrocarbons with associated gas and possibly containing smaller amounts of water, wherein at least one hydrocarbon-separating operation is carried out on the sea bed, and fluid hydrocarbons are carried up to a surface vessel, a platform or other sea-based installation.

Known technique comprises systems both with and without separator for the separation of gas from oil on sea bed level.

Known systems of the relevant kind working without separator for oil and gas placed on the sea bed, comprise high-pressure processing plant on board ships (production ships) and sea-based platforms for the treating of oil with associated gas. Known plants of this kind are space- and equipment-demanding and thereby very expensive. A very important condition in such treatment of hydrocarbons in a surface position is that the handling of said associated gas has to take place under high pressure, which requires extensive safety measures. It is also a significant drawback in this kind of processing plants that in addition to being voluminous and thereby space-demanding, they are extremely heavy, so that ships/platforms arranged thereto must be sized in order to take up both the volume and the weight of the processing plant.

Such high investment costs are connected to these known sea-based processing plants, that smaller hydrocarbon-producing fields in isolated locations, have been exploited only to a minor extent.

Underwater production well heads for untreated well flow have been used together with high-pressure processing plants on ships or platforms. It is known to inject seawater into wells from sea bed level, and it is also known to treat an oil flow at the sea bed in the separating of water, which is reinjected into the reservoir/formation in an immediately following operational step.

Known technique comprises i.a. NO B 152 730, NO B 166 145, NO C 173 838, NO 180 350 and U.S. Pat. No. 4,960,443.

Separators, in which gas and water are separated from the oil, form an essential component in such a sea-based processing plant, and with the purpose of guaranteeing savings, among other things, the separator(s) has (have) been placed on the sea bed in some cases. This is known from i.a. Norwegian patent document No. 173 838, in which several containers are placed on the sea bed with the purpose of separating oil and gas before further transport of these fluids in separate pipelines.

This known treatment of a hydrocarbon-based multiphase fluid is carried out in steps and comprises three or four separate phases.

Any water produced together with the oil, is separated from fluid and gaseous hydrocarbons in a first phase and can possibly be pumped back to the environment, i.e. into the sea, but because of the risk of contamination, it is often preferred instead to pump separated water back into the reservoir.

Gas separated from the oil in the sea bed separator is carried through a hose/pipeline to the surface and flared there. In these cases a flare tower with a burner does not necessarily have to be arranged on the production vessel, but rather on a separate buoy or similar floating structure in a surface position.

According to the Norwegian patent document No. 173 838 the oil is carried in a third phase to a tanker. The positioning of a separator(s) on the sea bed in this and similar connections is also generally known from U.S. Pat. Nos. 3,221,816, 3,556,218 and 3,608,630.

BRIEF DESCRIPTION OF THE INVENTION

In accordance with the present invention the treatment/handling of crude oil with associated gas and possibly water, is implemented in a way and by a plant (system) that differ from the two main principles mentioned above, namely (1) oil-gas-separation on surface level exclusively, or (2) oil-gas-separation on sea bed level exclusively.

According to the invention treatment of the well flow is carried out first on sea bed level and then in a surface position on board a sea-based vessel/platform/installation.

In a subsea part of the processing plant comprising, as the main component, at least one separator for oil:gas:water, a first non-completed separation or non-thorough separation of oil and gas is carried out according to the invention in such a way that the oil, which leaves this underwater separating process and is carried up to the surface vessel/platform contains a certain amount of gas, which is separated from the oil in a low-pressure plant aboard the ship/platform, i.e. in a surface position, the amount of gas carried in the oil and thus coming aboard the production vessel and, as mentioned already, being separated from the oil there in a low-pressure separator, is adjusted to the energy requirement for the operation of the total processing plant depending on supply of energy and comprising an underwater plant as well as a surface plant which can be driven by natural gas.

In practice it means that the separation accuracy of the sea bed separator is set (and/or pressure-adjusting measures are taken at sea bed level), so that it is ensured that an amount of gas will be carried aboard together with the oil within a defined period of time, which corresponds to the power consumption of the overall processing plant above and under water in said period of time.

Gas and water separated at the sea bed can be pumped back into the reservoir by means of subsea multiphase pumps.

As mentioned, water produced and some associated gas are separated in a subsea separator and returned to the reservoir, whereas in accordance with the present invention the rest of the gas is considered as an energy source for the operation of the plant, and is carried to the surface vessel together with the oil flow at low pressure—pressure on arrival topside is limited to e.g. 10 bar. As mentioned, the major part of the "intended" remaining gas is separated from the oil by means of a separate separator in a low-pressure plant on board the surface vessel. Here the last residue of water is also separated from the oil, for example in a centrifuge.

Ready-treated oil is transferred to storage tanks, whereas the gas separated on board the ship, is used as fuel for a power/effect generator, which can be arranged for operation of the subsea plant section of the processing plant and the plant section above water.

In practice, gas which might evaporate from the oil in the storage tanks of the ship/platform, could be used to generate power. Power-/effect-generating apparatus included in the above-water arrangement of the novel system, should not be integrated in the ship's/platform's other apparatus for power generation, but, on the contrary, form a separate independent machinery for the operation of a plant connected to the concerned treatment/handling of fluid hydrocarbons with associated gas and possibly containing water.

The amount of residual/consumption gas to be separated from the approximately predefined oil-gas-mixture aboard the surface vessel/platform is relatively small, and therefore auxiliary systems are required to a substantially smaller extent than if all separation was to be carried out in a surface position. The separator mounted on the surface can therefore be sized for a considerably lower pressure-class than normal, i.e. in known processing plants that have no separators on the sea bed, as the great pressures are taken care of in the subsea separator.

In the manner specified earlier, the residual gas is used for the generation of electric energy, i.e. as consumption gas, this so-called associated gas either being used directly as fuel for power generation, or the gas being used as fuel in a steam boiler which produces steam for a steam turbine connected to an electric generator.

Electric energy generated is used partly for the operation of subsea equipment, such as a separator for high-pressure conditions, multiphase pumps etc., partly for the operation of surface-based equipment, a small separator for low-pressure conditions etc.

The previously described method and system arranged in accordance with the present invention, assume that electric power is generated at all times by means of the associated gas transferred to the surface and separated there from the oil, to an extent sufficient for operating the plants included in the system for the handling of said fluid hydrocarbons with associated gas and possibly containing water. This requires in its turn that the system according to the invention is arranged adjustment-technically to allow control thereof, so that the necessary amount of gas for power generation is available at any time.

This control/adjustment can be implemented by setting and adjusting the separation conditions of the separator on the sea bed, so that the amount of gas separated is changed in the way desired, i.e. in accordance with the overall gas-based working power requirements of the system/the total processing plant, so that the oil transferred to the surface carries along an amount of associated gas, which is adjusted per time unit to the fuel requirement, or exceeds it to an insignificant degree.

Another possibility of control is to use a multiphase pump arranged in front of the separator on the sea bed. By changing the admission on this pump, the amount of well flow which is "drawn up" is controlled. Thereby the amount of well flow entering the separator will be changed, which brings about a change in the amount of oil with associated gas produced in the separation on the sea bed. By low separation pressure a pump may be installed downstream of the separator.

A combined above-water/underwater plant/system in accordance with the present invention can be constructed and adjusted according to the prevailing conditions on the field so that such handling of the produced hydrocarbons is allowed that emission of contaminated water or emission/flaring of exhaust gas can be avoided, if so dictated by the conditions. In practice the system may thus be arranged to work without exhaust gas, as all the gas produced is either used as fuel in processes connected to the system according to the invention, i.e. for the generation of power for the operation of the hydrocarbon handling plant as indicated in the foregoing, or is reinjected into the underground.

BRIEF DESCRIPTION OF THE DRAWING

In the following description of an exemplary embodiment which represents a simplified system with a subsea plant section and a surface plant section, shown in a highly schematized representation in FIG. 1 in the appended drawing.

DETAILED DESCRIPTION OF THE INVENTION

Figure 1:
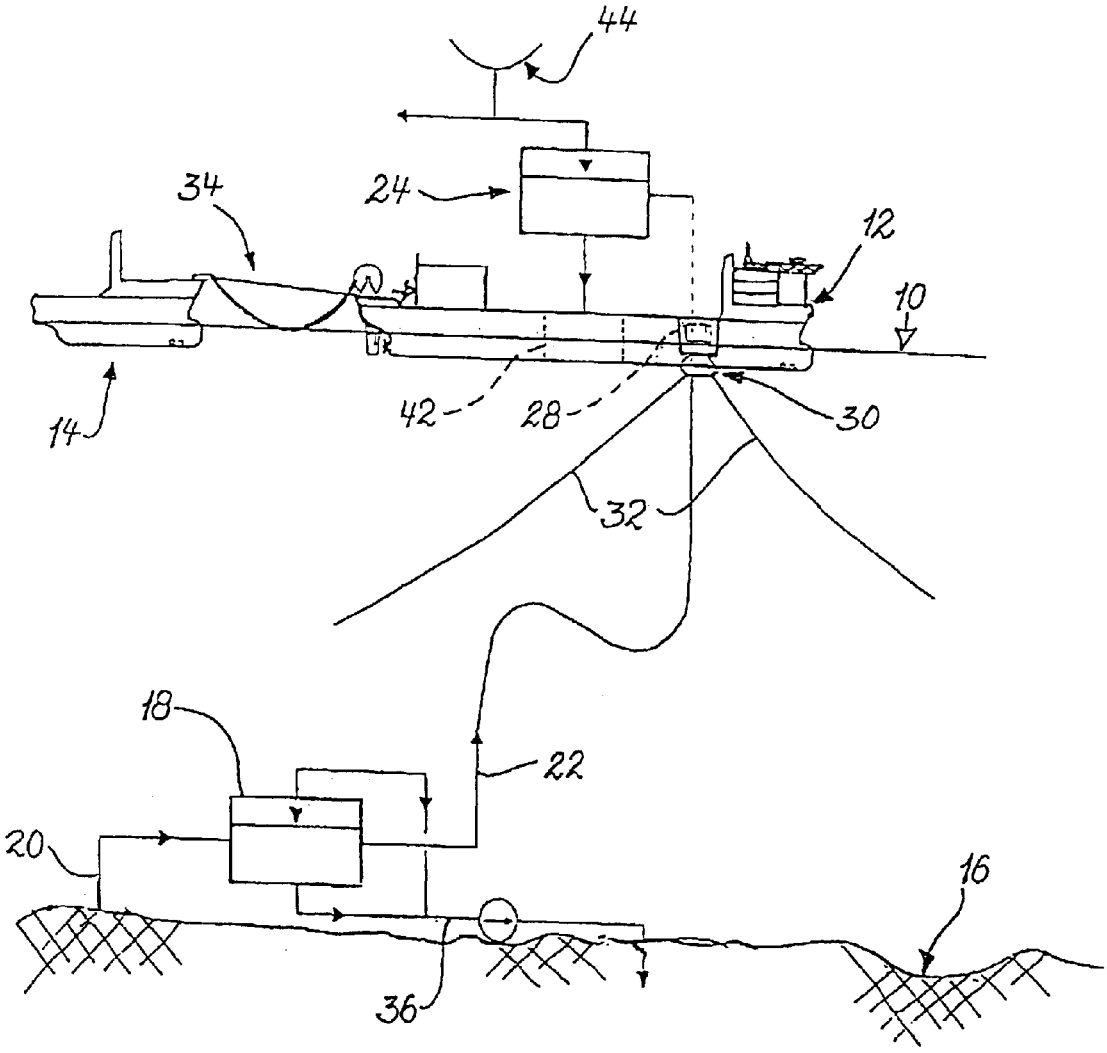

Reference is made to FIG. 1 representing a side view of the plant elements of the system, above and under the water surface 10.

The reference numeral 12 identifies a surface vessel in the form of a production ship, in the present invention forming a ship-based floating production system, whereas 14 identifies a shuttle tanker.

On the sea bed 16 is arranged a subsea first separator 18 (high-pressure separator) which receives an unprocessed well flow as suggested at 20.

As described earlier, this first separator 18 is formed, arranged, adapted and adjusted to subject the supplied well flow (at 20) to such a degree of separation that the oil flow delivered through a riser/hose 22 contains a predefined percentage of associated gas which is to cover the operation of the hydrocarbon processing plants, both above and under the sea surface 10.

Aboard the production ship 12 there is arranged a second step separator 24 for the separation of the residual gas/consumption gas and water carried in the oil up to the ship 12.

Reference numerals 28 and 30 identify a high-pressure swivel and an anchoring buoy, respectively; well-known components in connection with such ship-based oil production. 32 identifies mooring hawsers leading from the buoy 30 down to anchors (not shown) on the sea bed 16. This is to be understood only as an example of a possible anchoring system.

Unloading equipment aft on the production ship 12 is identified by 34. This also represents just an example of a possible unloading system.

The reference numeral 44 identifies a flare tower for possible flaring of excess gas, whereas 42 suggests placing of loading tank on board the production ship 12.

What is claimed is:

1. A system for sea-based handling of fluid hydrocarbons obtained from an oil reservoir in a seabed, the fluid hydrocarbons also comprising gas and water, the system comprising:

a first separator installed on the seabed, the first separator arranged to receive a flow of fluid hydrocarbons from the reservoir, separate a predetermined amount of gas and water from the flow of fluid hydrocarbons, and output the remaining flow of fluid hydrocarbons, wherein the remaining output flow of fluid hydrocarbons comprises an essentially predetermined percentage of residual gas;

wherein the first separator is further arranged to return the separated amount of gas and water to the reservoir; and a riser coupled to the first separator and arranged to transport the output flow of fluid hydrocarbons from the first separator to surface equipment for further handling;

wherein the surface equipment comprises a second separator for separating the residual gas from the output flow of fluid hydrocarbons, and wherein the residual gas provides a fuel source for operation of the system.

2. The system of claim 1, wherein the residual gas is used as a power source for operation of the system, including the surface equipment and the first separator.

3. The system of claim 1, wherein the surface equipment comprises at least one of a ship and a sea-based platform.

4. The system of claim 1, wherein the surface equipment further comprises means for storing the output flow of fluid hydrocarbons.

5. The system of claim 1, wherein the surface equipment comprises a gas turbine which is arranged to use the residual gas as fuel.

6. The system of claim 5, wherein the gas turbine is connected to a generator for the generation of electric power to be used for the operation of the system.

7. The system of claim 1, wherein the surface equipment comprises a steam boiler that is arranged to receive the residual gas as fuel to thereby produce steam as input to a steam turbine, the steam turbine connected to a generator for the generation of electric power for operation of the surface equipment and subsurface equipment, including the first separator.

8. The system of claim 1, wherein the first separator further comprises a controller for controlling the flow per time unit of the flow of fluid hydrocarbons into the first separator in order to thereby adjust the gas separation rate of the first separator.

9. The system of claim 1, further comprising a pump device installed on the seabed in a position that is upstream of the first separator, the pump device arranged to control the flow of fluid hydrocarbons into the first separator.

10. A method of sea-based handling of fluid hydrocarbons obtained from an oil reservoir in a seabed, the fluid hydrocarbons also comprising gas and water, the method comprising the steps of:

separating a predetermined amount of gas and water from the fluid hydrocarbons at the seabed, such that the fluid hydrocarbons comprises an essentially predetermined percentage of residual gas;

returning the separated gas and water to the reservoir;

transferring the flow of hydrocarbons to surface equipment;

separating the residual gas from the fluid hydrocarbons; and utilizing the residual gas as a power source for sub-sea and surface gas and water separation equipment.

11. The method of claim 10, further comprising the step of utilizing the residual gas as a power source for surface fluid hydrocarbon management and treatment equipment.

12. The method of claim 10, further comprising the step of returning the separated residual gas from the surface to the reservoir.

13. The method of claim 10, wherein the residual gas is used as fuel for the generation of electric power, which is used to drive components in the sub-sea gas and water separation equipment and components in the surface equipment.

14. The method of claim 10, wherein the residual gas is used as fuel in a gas turbine which is connected to a generator for the generation of electric energy.

15. The method of claim 10, wherein the residual gas is used as fuel in a steam boiler which produces steam to be supplied to a steam turbine, which is connected to a generator for generation of electric energy.

16. The method of claim 10, further comprising the step of controlling the separation at the seabed such that the percentage of separated gas is changed in a desired manner.

17. The method of claim 10, further comprising the step of controlling the separation at the seabed by changing well flow per unit time entering a separator installed on the seabed, so that output rate of the flow of fluid hydrocarbons from the separator is changed.

18. The method of claim 10, wherein fluid hydrocarbons are transferred at a pressure that is substantially the same as the pressure of the fluid hydrocarbons in the reservoir.

* * * * *